US007539437B2

(12) United States Patent
Yamada

(10) Patent No.: US 7,539,437 B2
(45) Date of Patent: May 26, 2009

(54) IMAGE FORMING APPARATUS INCLUDING A TONER STAIN REMOVAL DEVICE FOR REMOVING A TONER STAIN ADHERING TO A REAR SURFACE OF A SHEET

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 426 days.

(21) Appl. No.: 11/466,912

(22) Filed: Aug. 24, 2006

(65) Prior Publication Data

US 2007/0048001 A1 Mar. 1, 2007

(30) Foreign Application Priority Data

Aug. 29, 2005 (JP) ..... 2005-248259

(51) Int. Cl.
*G03G 15/00* (2006.01)

(52) U.S. Cl. ..... 399/99; 399/390

(58) Field of Classification Search ..... 399/98, 399/99, 390, 397, 400, 45
See application file for complete search history.

(56) References Cited

U.S. PATENT DOCUMENTS 5,722,012 A * 2/1998 Saitoh ..... 399/99
6,882,820 B2 4/2005 Shinshi et al.

FOREIGN PATENT DOCUMENTS

JP 1-104560 A 4/1989
JP 1-121882 A 5/1989
JP 7-175284 A 7/1995
JP 2001-42664 2/2001
JP 2003-248346 A 9/2003
JP 2004-133377 A 4/2004

* cited by examiner

*Primary Examiner*—William J Royer
(74) *Attorney, Agent, or Firm*—Fitzpatrick, Cella, Harper & Scinto

(57) ABSTRACT

An image forming apparatus includes an image bearing member for bearing a toner image; a transfer device for transferring the toner image onto a sheet from the image bearing member; a fixing device for fixing on the sheet the toner image which has been transferred onto the sheet; a cleaning member arranged on a side of the transfer device with respect to the sheet to be transported from the transfer device to the fixing device, for removing a toner stain adhering to the sheet; a biasing device for biasing the sheet against a side of the cleaning member; and a controller for regulating a biasing force of the biasing device according to a type of the sheet.

11 Claims, 8 Drawing Sheets

| | | VACUUM AIRFLOW SPEED |
|---|---|---|
| THICK SHEET (160g/m$^2$) | 1st SURFACE<br>2nd SURFACE | 0m/s<br>0m/s |
| NORMAL SHEET (80g/m$^2$ OR MORE LESS THAN 160g/m$^2$) | 1st SURFACE<br>2nd SURFACE | 1.7m/s<br>2.3m/s |
| THIN SHEET (52g/m$^2$ OR MORE LESS THAN 80g/m$^2$) | 1st SURFACE | 1.9m/s |

| | | APPLIED VOLTAGE |
|---|---|---|
| THICK SHEET (160g/m$^2$ OR MORE) | 1st SURFACE | 0V |
| | 2nd SURFACE | 0V |
| NORMAL SHEET (80g/m$^2$ OR MORE LESS THAN 160g/m$^2$) | 1st SURFACE | 500V |
| | 2nd SURFACE | 1200V |
| THIN SHEET (52g/m$^2$ OR MORE LESS THAN 80g/m$^2$) | 1st SURFACE | 800V |

IMAGE FORMING APPARATUS INCLUDING A TONER STAIN REMOVAL DEVICE FOR REMOVING A TONER STAIN ADHERING TO A REAR SURFACE OF A SHEET

BACKGROUND OF THE INVENTION

1. Field of the Invention

The present invention relates to an image forming apparatus including a toner stain removal device for removing a toner stain adhering to a rear surface of a sheet.

2. Description of the Related Art

In general, in image forming apparatuses for forming an image on a sheet by an electrophotographic process, such as a copying machine, a printer, and a facsimile, a toner image is formed on the sheet in a manner as described below.

First, a photosensitive member is charged to a predetermined polarity by a charger. Then, an electrostatic latent image which corresponds to an image formed on an original is formed on a surface of the photosensitive member. Then, the electrostatic latent image is developed by a developer which is arranged at a predetermined position around the photosensitive member. To be specific, the electrostatic latent image is developed with toner, which is a charged fine powder and is supplied from the developer, thereby obtaining a toner image. The toner image formed on the photosensitive member reaches a transferring part through rotation of the photosensitive member to be directly transferred onto a transfer material (hereinafter, referred to as "sheet") which has been transported to the transferring part. In some types of image forming apparatuses, there is a case where a toner image is not directly transferred onto a sheet from the photosensitive member, but is temporarily transferred onto an intermediate transfer member before being transferred onto the sheet. In any type of image forming apparatuses, the toner image is transferred onto the transported sheet. In the transferring part, the sheet is transported to a fixing part while the toner image is transferred onto the sheet. In the fixing part, the sheet is heated and pressurized to thereby fix the toner image on the sheet. Finally, a sheet delivery part delivers the sheet onto a sheet stacking tray.

In such image forming apparatuses, there is a fear of a toner stain adhering to a surface on an opposite side (i.e., rear surface) of a sheet on which a toner image is formed.

In other words, in the transferring part for transferring a toner image onto a sheet by using a transfer roller, the transfer roller is always in contact with the photosensitive member or the intermediate transfer member (hereinafter, both of which are collectively referred to as "image bearing member"), so base-staining toner of the image bearing member is transferred onto the transfer roller, and then the toner adheres to the rear surface of the sheet, thereby staining the rear surface of the sheet. Therefore, in order to prevent the sheet from being stained, it is a serious problem how to prevent the toner stain from adhering to the rear surface of the sheet, or how to remove the toner stain when the toner stain adheres to the rear surface of the sheet. The stain is usually removed by bringing a cleaning member, which is arranged around the transfer roller, into contact with a surface of the transfer roller.

However, in a marginless image forming apparatus for forming a toner image on a sheet with no margin on the periphery of the sheet, there is a case where the apparatus does not exert a sufficient cleaning ability only by providing the cleaning member, thereby adhering an unnecessary toner stain to the rear surface of the sheet.

The marginless image forming apparatus has a structure in which a toner image which is larger in size than a sheet is formed on the image bearing member. As a result, a portion of the toner image which runs off the edge of the sheet is transferred onto the transfer roller. A toner amount of this case is large as compared with a normal amount of the base-staining toner, so the cleaning ability of the cleaning member is not sufficient to clean the toner, which results in causing adhesion of a toner image to the rear surface of the sheet as the toner stain.

Therefore, there is conventionally provided a toner stain removal device for removing the toner stain adhering to the rear surface of the sheet (see FIG. 4 of JP 2001-42664 A). The toner stain removal device has such a structure that a sheet is brought into contact with a toner removal roller which serves as a cleaning member and is arranged between a transferring part and a fixing part and on the transferring part side, by a suction force of a fan, thereby cleaning directly the rear surface of the sheet through rotation of the toner removal roller. It should be noted that the toner stain adhering to the rear surface of the sheet is not fixed onto the sheet because the sheet has not passed the fixing part, thereby being removed through rotation of the toner removal roller.

However, in the toner stain removal device described in JP 2001-42664 A, a contact state of the sheets with respect to the toner removal roller vary between a thick sheet and a thin sheet because the suction force of the fan is kept constant. Accordingly, it is difficult to remove the toner stain adhering to some sheets with a certain thickness.

In addition, when the suction force of the fan is kept constant, in a case where an image forming mode is set to a mode of forming images on both surfaces of the sheet, the following problem arises.

Because the sheet is heated in the fixing part upon passing the fixing part, there is a fear of a toner image being curled (i.e., warps) to an opposite side of a surface onto which the toner image is transferred. As a result, when the toner image is formed on a second surface of the sheet subsequently to a first surface thereof, the sheet is turned over by a sheet reverse path, so a direction of the curl when the sheet passes the toner removal roller is a direction in which the sheet is apart from the toner removal roller.

Therefore, in the conventional toner stain removal device, a contact property of the sheet with respect to the toner removal roller deteriorates when the sheet the second surface of which has been transferred with the toner image, passes the toner removal roller of the toner stain removal device, thereby making it difficult to reliably remove the toner stain adhering to the first surface of the sheet.

Further, in the image forming apparatus including the toner stain removal device by which the toner stain adhering to the rear surface of the sheet is not reliably removed, there is a problem in that it is difficult to provide a sheet having a toner image formed thereon with less staining.

SUMMARY OF THE INVENTION

An object of the present invention is to provide an image forming apparatus capable of removing a toner stain with ease by regulating a biasing force of a sheet with respect to a cleaning member for removing the toner stain adhering to a rear surface of a sheet according to types of sheets and image forming modes.

Another object of the present invention is to provide an image forming apparatus including a toner stain removal device capable of removing the toner stain adhering to the rear surface of the sheet with ease, and being capable of providing a sheet on which a toner image is formed with less staining.

According to one aspect of the present invention, to attain the above-mentioned objects, an image forming apparatus includes: an image bearing member which bears a toner image; a transfer device for transferring the toner image onto a sheet from the image bearing member; a fixing device which fixes on the sheet the toner image which has been transferred onto the sheet; a cleaning member which is arranged on a side of the transfer device with respect to the sheet to be transported from the transfer device to the fixing device, and removes a toner stain adhering to the sheet; a biasing device for biasing the sheet against a side of the cleaning member; and a controller which regulates a biasing force of the biasing device according to a type of the sheet.

According to another aspect of the present invention, an image forming apparatus includes: an image bearing member which bears a toner image; a transfer device which transfers the toner image onto a sheet from the image bearing member; a fixing device which fixes on the sheet the toner image which has been transferred onto the sheet; a cleaning member which is arranged on a side of the transfer device with respect to the sheet to be transported from the transfer device to the fixing device, and removes a toner stain adhering to the sheet; a biasing device for biasing the sheet against a side of the cleaning member; and a controller which regulates a biasing force of the biasing device according to an image forming mode.

Further objects and features of the present invention will become apparent from the following description of exemplary embodiments with reference to the attached drawings.

DESCRIPTION OF THE EMBODIMENTS

Hereinafter, an image forming apparatus according to an embodiment of the present invention and a toner stain removal device provided to the image forming apparatus will be described with reference to the drawings.

The image forming apparatus according to this embodiment of the present invention will be described by taking a four-color (i.e., full-color) laser beam printer (hereinafter, referred to simply as "printer") as an example. Note that the image forming apparatus according to the present invention is not limited to the printer. The image forming apparatus according to the present invention is also applied to a copying machine, a facsimile, and a composite machine having these functions. In addition, the toner stain removal device is not only provided to the printer, but also provided to a copying machine, a facsimile, a composite machine having these functions.

Further, the image forming apparatus according to this embodiment has a structure in which a color toner image formed on an intermediate transfer belt is transferred onto a sheet. However, the image forming apparatus according to this embodiment may be an image forming apparatus of a type in which a toner image formed on a photosensitive drum is transferred onto a sheet. Accordingly, the toner stain removal device can remove a toner stain not only when the toner stain removal device is provided to the printer according to this embodiment, but also when the toner stain removal device is provided to the image forming apparatus of the type in which the toner image formed on the photosensitive drum is transferred onto the sheet.

It should be noted that, in the present invention, a surface of a sheet on which an image is first formed is called "first surface", and a surface a sheet on which an image is subsequently formed is called "second surface" In addition, a surface of the sheet onto which the image is transferred is called "front surface", and a surface opposite to the front surface is called "rear surface".

Further, numerical values adopted in the following are merely reference numerical values, so such the values do not limit the present invention.

(Image Forming Apparatus)

Figure 1:
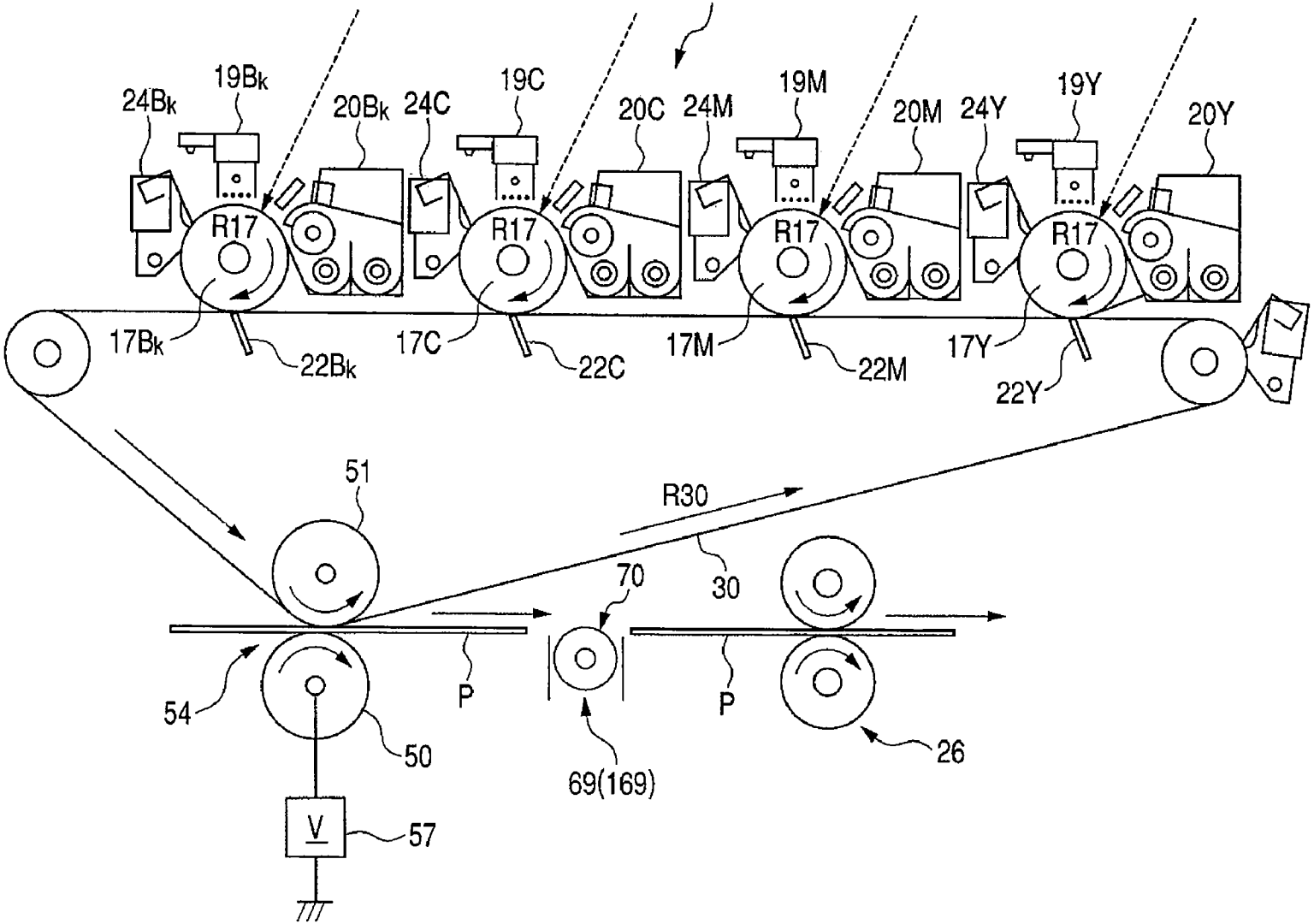
FIG. 1 is a schematic sectional view taken along a sheet transport direction of a printer serving as an image forming apparatus according to an embodiment of the present invention.

FIG. 1 is a schematic sectional view taken along a sheet transport direction of a printer. In a printer 1, color toner images are formed on a sheet by using toner of four colors.

The printer 1 includes a toner stain removal device 69 (or 169) for removing a toner stain adhering to a rear surface of a sheet P with ease to thereby provide a sheet P on which a toner image is formed with less staining.

The printer 1 includes drum-type electrophotographic photosensitive members (hereinafter, referred to as "photosensitive drum") 17Y, 17M, 17C, and 17Bk which serve as first bearing members. On the peripheries of the photosensitive drums 17Y, 17M, 17C, and 17Bk, there are arranged first charging devices 19Y, 19M, 19C, and 19Bk, developing devices 20Y, 20M, 20C, and 20Bk, and cleaning devices 24Y, 24M, 24C, and 24Bk, and the like.

Surfaces of the photosensitive drums 17Y, 17M, 17C, and 17Bk are uniformly charged by the first charging devices 19Y, 19M, 19C, and 19Bk, while each of the photosensitive drums 17Y, 17M, 17C, and 17Bk rotates in a direction indicated by the arrows R17 by a driving source (not shown). On the surfaces of the photosensitive drums 17Y, 17M, 17C, and 17Bk, an optical image obtained by separating a color image into colors, or an optical image corresponding thereto is irradiated by a polygon mirror, a reflecting mirror, and the like (not shown), thereby forming an electrostatic latent image. After that, the electrostatic latent image formed on each surface of the photosensitive drums 17Y, 17M, 17C, and 17Bk is developed with toner by the developing devices 20Y, 20M, 20C, and 20Bk, and is visualized as a toner image. It should be noted that the developing devices 20Y, 20M, 20C, and 20Bk contain magenta toner (i.e., magenta developer), yellow toner (i.e., yellow developer), cyan toner (i.e., cyan developer), and black toner (i.e., black developer), respectively.

The color toner images formed on each surface of the photosensitive drums 17Y, 17M, 17C, and 17Bk are subsequently primarily-transferred onto an intermediate transfer belt 30, which circulates around the photosensitive drums 17Y, 17M, 17C, and 17Bk and serves as a second image bearing member, by first transfer devices 22Y, 22M, 22C, and 22Bk. The intermediate transfer belt 30 circulates in a direction indicated by the arrow R30. After the primary transfer, residual toner remaining on each surface of the photosensitive drums 17Y, 17M, 17C, and 17Bk is removed by the cleaning devices 24Y, 24M, 24C, and 24Bk.

The four color toner images superimposed on the intermediate transfer belt 30 are moved to a second transfer device 54 through circulation of the intermediate transfer belt 30. Then, the toner images are collectively secondarily-transferred onto a sheet P which has been transported by a sheet supplying device (not shown) by the second transfer device 54.

The second transfer device 54 is composed of a second transfer outer roller 50, a second transfer inner roller 51, a voltage supply part 57, and the like. A bias having a polarity reverse to that of the toner image is applied to the second transfer outer roller 50 by the voltage supply part 57. In the second transfer device 54, the four-color toner image is transferred onto the sheet P which enters a nip portion in which the intermediate transfer belt 30 is nipped by the second transfer outer roller 50 and the second transfer inner roller 51, simultaneously with entrance of the four-color image into the nip portion. This transfer is performed by sucking and absorbing the toner image on the sheet P when the sheet P is also charged to a reverse polarity by the second transfer outer roller 50 which is applied with the bias having the polarity reverse to the toner image.

The sheet P onto which the four-color toner image is transferred is transported to a fixing device 26 while a non-transfer surface (i.e., rear surface) of the sheet P is brought into contact with the toner stain removal device 69 to be described below. Then, the fixing device 26 heats and pressurizes the sheet P to fix the four-color toner image on the sheet P.

In this case, when a one-side mode of forming a toner image on only one surface of the sheet is set, the printer 1 delivers the sheet to the outside of the printer 1 as it is.

If a two-side mode of forming toner images on both surfaces of the sheet P is set, the printer 1 guides the sheet P, which has passed the fixing device 26, into a sheet reverse path (not shown) to turn over the surface of the sheet P, and then forms a toner image on a second surface side by performing transfer and fixing, thereby delivering the sheet P to the outside of the printer 1.

Herein, when the toner image is formed on the entire surface of the sheet P, the printer 1 transfers onto the intermediate transfer belt 30 the toner image which is formed a little larger in size than the entire surface of the sheet P.

To be specific, if the toner image having the same size as the entire surface of the sheet P is transferred onto the intermediate transfer belt 30, and the sheet P is transported to the second transfer device 54 with a slight deviation such as an early arrival, a delay, and a lateral slippage, it is impossible to transfer the toner image onto the entire surface of the sheet P.

As a result, when forming the electrostatic latent image on each of the photosensitive drums 17Y, 17M, 17C, and 17Bk, the printer 1 according to this embodiment forms, for example, an electrostatic latent image having height and width sizes of 214.2 mm×302.9 mm which is obtained by enlarging by 2% the sheet P having height and width sizes of 210 mm×297 mm, for each color. After that, the electrostatic latent images are visualized as toner images by the developing devices 20Y, 20M, 20C, and 20Bk, and are superimposed on the intermediate transfer belt 30 by the first transfer devices 22Y, 22M, 22C, and 22*b*K, thereby forming a toner image which is obtained by superimposing the four color images and by enlarging the size of the transfer material by 2%.

Figure 2:
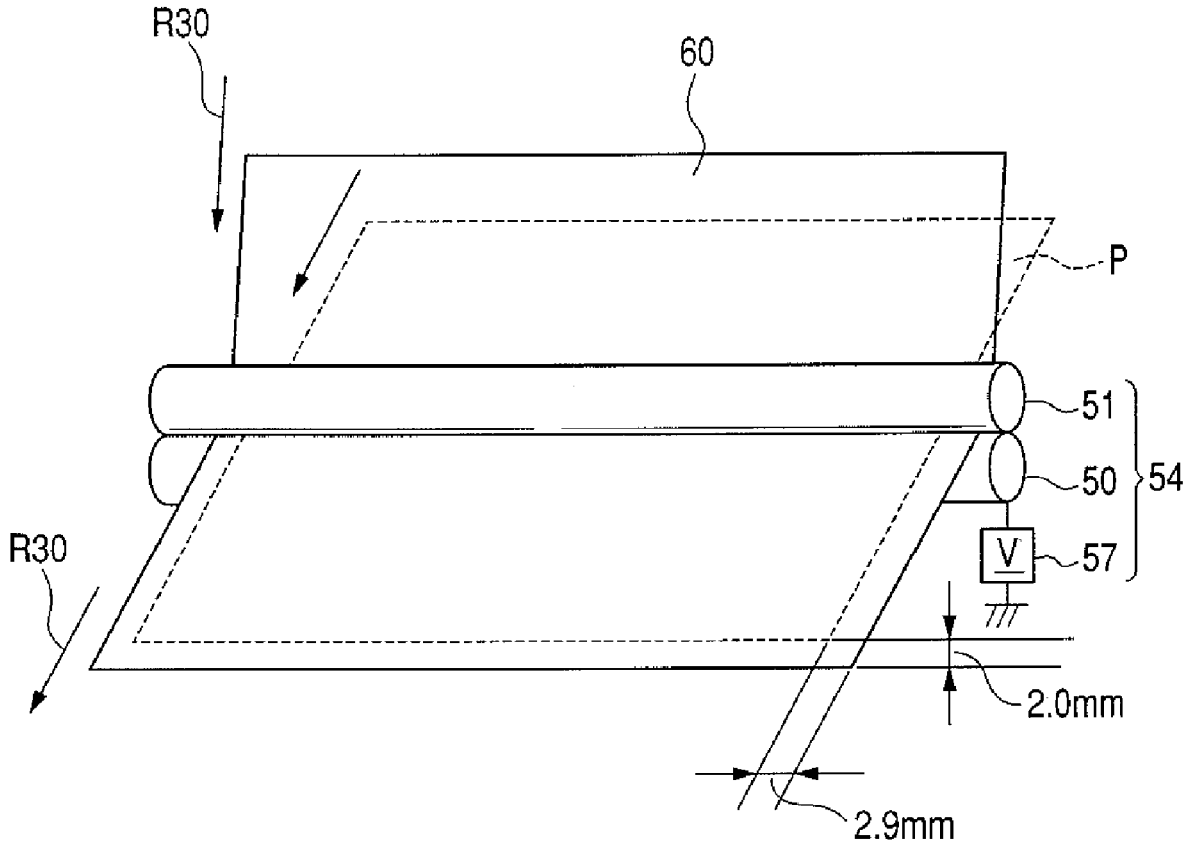
FIG. 2 is a diagram showing a relative positional relationship between a sheet and a four-color toner image of a second transfer device of the printer shown in FIG. 1.

The second transfer device 54 transfers a toner image 60 which is enlarged by 2% onto the sheet P. FIG. 2 is a diagram showing a relative positional relationship between the sheet P and the four-color toner image 60 in the second transfer device 54. The four-color toner image 60 on the intermediate transfer belt 30 (see FIG. 1) is formed so as to keep a positional relationship in which the four-color toner image 60 runs off the edge of the sheet P in a vertical direction (i.e., transport direction) by 2.0 mm and in a horizontal direction (i.e., longitudinal direction) by 2.9 mm, thereby reaching the second transfer device 54.

Therefore, even when the sheet P is slightly deviated due to a transportation to the second transfer device 54, it is possible for the printer 1 to form a favorable non-margin image without providing any margin on a periphery of a sheet P.

However, in the four-color toner image 60 on the intermediate transfer belt 30, the toner running off the edge of the sheet P is not transferred onto the sheet P in the secondary-transfer but is transferred onto the second transfer outer roller 50. Further, the toner transferred onto the second transfer outer roller 50 adheres to the non-transfer surface (i.e., rear surface) of the current sheet P or a subsequent sheet P to be transported, thereby staining the rear surface of the sheet P.

Figure 3:
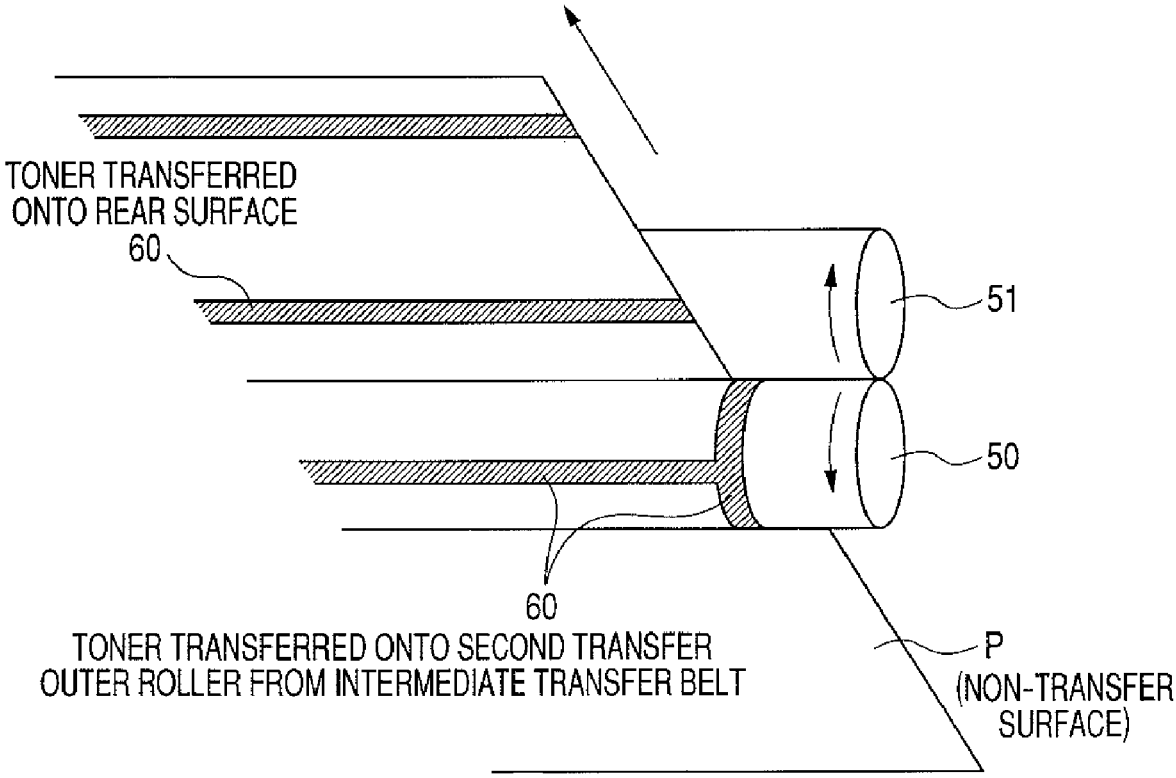
FIG. 3 is a diagram showing the second transfer device of the printer shown in FIG. 1 when viewed from a lower downstream side thereof.

FIG. 3 is a diagram showing the second transfer device 54 viewed from a lower downstream side thereof. As shown in FIG. 3, the four-color toner image 60 on the intermediate transfer belt 30 is transferred onto the second transfer outer roller 50, and thereafter adheres to the non-transfer surface (i.e., rear surface) of the sheet P, thereby staining the rear surface of the sheet P.

As described above, when the toner stain is transferred onto the rear surface of the sheet P to cause a stain on the rear surface of the sheet P, the toner stain is removed by the toner stain removal device 69(169) to be described later. It should be noted that there is a case where the toner stain is caused on the rear surface of the sheet P not only by the residual toner generated when the toner image is formed on the entire surface of the sheet P but also by the toner having adhered to the second transfer outer roller 50 for a long period of time. In this case, the toner stain is also removed by the toner stain removal device 69(169).

Therefore, the printer 1 includes the toner stain removal device 69 (or 169) capable of easily removing the toner stain adhering to the rear surface of the sheet P, so the printer 1 can provide the sheet on which the toner image is formed with less staining.

(Toner Stain Removal Device According to a First Embodiment)

Figure 4:
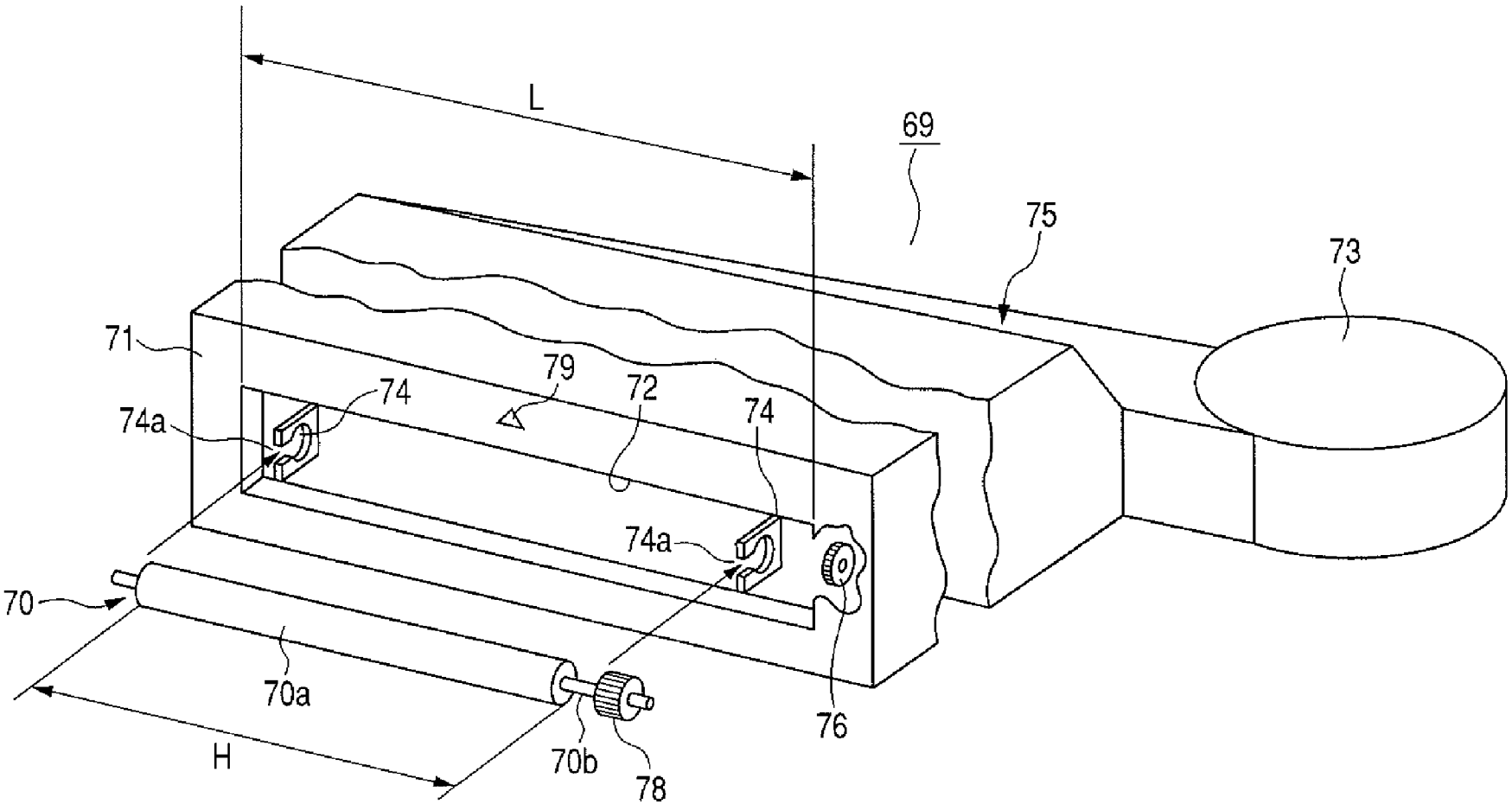
FIG. 4 is an exploded perspective view partially showing a toner stain removing device according to a first embodiment.
Figures 5, 6:
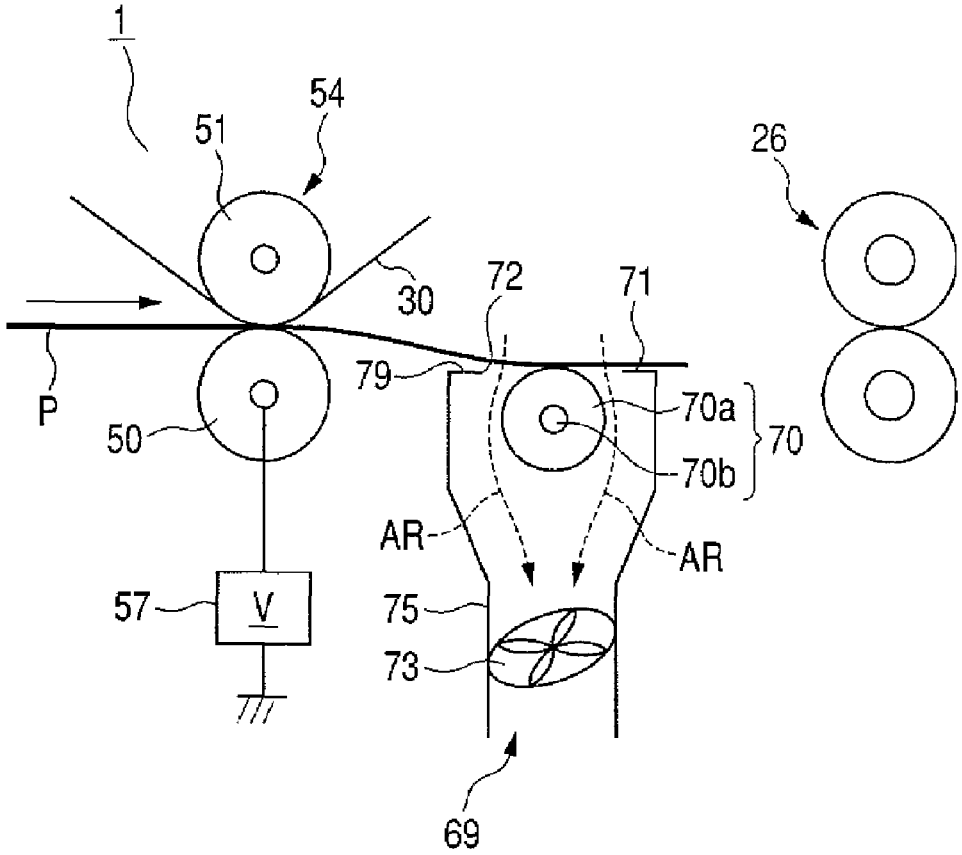
FIG. 5 is a schematic sectional view of the toner stain removal device shown in FIG. 4.
FIG. 6 is a table showing an experimental result of an optimum vacuum airflow speed for each sheet which is obtained by changing the vacuum airflow speed of an air vacuum fan and by checking with eyes to confirm a contact state between a sheet and a roller main body, and a removal state of toner stain.

FIG. 4 is an exploded perspective view partially showing a toner stain removing device (69) according to a first embodiment. FIG. 5 is a schematic sectional view of the toner stain removal device 69 shown in FIG. 4.

The toner stain removal device 69 according to this embodiment has a structure in which a suction force of an air vacuum fan 73 can be regulated according to types of sheets P and image forming modes to remove a toner stain adhering to a rear surface of a sheet P and clean the rear surface of the sheet P irrespective of the types of the sheets P and the image forming modes.

(Description of the Structure)

The toner stain removal device 69 includes a toner removal roller 70 serving as a cleaning member, the air vacuum fan 73 serving as a biasing device, and an air vacuum duct 75.

The toner removal roller 70 is arranged on a side of the second transfer device 54 with respect to the sheet P which is transported from the second transfer device 54 to the fixing device 26, and is brought into contact with the rear surface of the sheet P, thereby removing an unnecessary toner stain adhering to the rear surface of the sheet P. The toner removal roller 70 is composed of a roller main body 70*a* which is in contact with the rear surface of the sheet P, and a rotation axis 70*b* which rotatably supports the roller main body 70*a* with respect to the air vacuum duct 75.

In addition, used herein as the toner removal roller 70 is a rotary brush roller (having a bristle length of 5 mm) made of polyamide synthetic fibers (trade name; nylon) which are optimum for scraping off and recovering the toner stain. However, a rubber roller adopting rubber to which toner is more likely to adhere, and a metal roller may be used.

Further, the rotary brush roller used as the toner removal roller 70 may be replaced with a fixed band-like brush which is arranged in a direction crossing the sheet transport direction.

In FIG. 4, a width H of the roller main body 70*a* is set to be wider than a maximum width of the sheet P to be passed. Thus, the width of the roller main body 70*a* is set to be wider than the maximum width of the sheet P to be passed to allow the width of the roller main body 70*a* to have a sufficient space, thereby making it possible to easily remove the toner stain adhering to the rear surface of the sheet P by using the roller main body 70*a* even when the sheet P is misaligned and obliquely transported.

One end of the rotation axis 70*b* of the roller main body 70*a* is provided with a driven gear 78. The driven gear 78 is engaged with a drive gear 76 which is provided at a transport guide member 71 side, in a state where the roller main body 70*a* is incorporated into a bearing 74. Accordingly, the drive gear 76 is rotated by receiving a driving force from a driving source (not shown) to rotate the toner removal roller 70 through the driven gear 78 at the same speed as the sheet transport direction in a direction opposite to the sheet transport direction. Note that a rotational speed and a rotation direction of the toner removal roller 70 are not limited thereto. Since the toner removal roller 70 is a roller for removing the toner stain adhering to the sheet P, it is sufficient that the rotational speed and the rotation direction of the toner removal roller 70 are set so as to generate a speed difference with respect to the sheet P to be transported.

Further, the toner removal roller 70 is supported by the bearing 74 in which an opening portion 74*a* is formed for the rotation axis 70*b*, and the driven gear 78 is engaged with the drive gear 76, so the toner removal roller 70 is mounted to be detachable from an air vacuum port 72 of the transport guide member 71 with respect to the bearing 74. As a result, the toner removal roller 70 is dismounted from the bearing 74, thereby making it possible to maintain the toner removal roller 70 to be clean by removing unnecessary toner adhering thereto.

A length L of the air vacuum port 72 provided to the transport guide member 71 which is a part of the air vacuum duct 75 is set to be longer than the maximum width of 360 mm for the printer 1 to form an image on a sheet P. On a bottom portion of the air vacuum duct 75, the air vacuum fan 73 is provided. The air vacuum fan 73 is provided for sucking air into the air vacuum duct 75 to reliably bring the sheet P into contact with the roller main body 70*a*.

(Description of the Operation)

When the air vacuum fan 73 is started up by a certain driving part (not shown), air is sucked into the air vacuum duct 75 from the air vacuum port 72, thereby generating airflows as indicated by the arrows AR (see FIG. 5). As a result, the sheet P transported to the toner stain removal device 69 is sucked to the toner removal roller 70 and brought into contact with the roller main body 70*a*. In this case, the toner removal roller 70 has already rotated to remove the toner stain adhering to the rear surface of the sheet. The toner stain adhering to the rear surface of the sheet P is not fixed on the sheet because the sheet P has not passed the fixing device 26, so the toner F stain is removed through rotation of the toner removal roller 70.

A vacuum airflow speed of sucking the sheet by the air vacuum fan 73 is measured by an airflow speed measuring sensor 79 provided at an airflow speed measuring position of the transport guide member 71. The vacuum airflow speed is set as shown in FIG. 6. FIG. 6 is a table showing an experimental result of an optimum vacuum airflow speed for each sheet which is obtained by changing the vacuum airflow speed of the air vacuum fan 73 and by visually checking to confirm a contact state between the sheet P and the roller main body 70*a*, and a removal state of toner stain.

Data shown in FIG. 6 was obtained under a circumstance in which a room temperature is 23° C., a humidity is 50%, and an amount of water contained in a sheet is 8.74 gr/kg. The sheets to be measured are a thick sheet (i.e., sheet having a large thickness) having a base weight of 160 g/m$^2$ a normal sheet (i.e., plain sheet) having a base weight of 80 g/m$^2$ or more and less than 160 g/m$^2$; and a thin sheet (i.e., sheet having a small thickness) having a basis weight of 52 g/m$^2$ or more and less than 80 g/m$^2$. Each size of the sheets is an A3-size. With regard to the normal sheet and the thick sheet, a confirmation as to a two-side mode of forming a toner image on both sides of a sheet was also made. With regard to the thin sheet, the confirmation as to the two-side mode was not made because show-through occurs significantly in the thin sheet (i.e., the sheet can be seen through).

Figure 7:
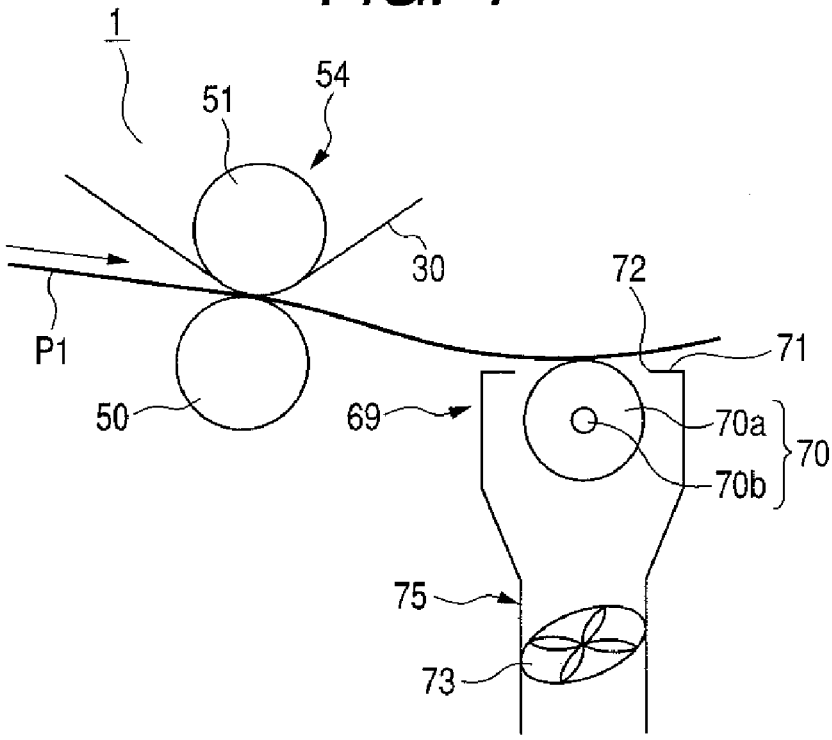
FIG. 7 is a diagram showing a state of a thick sheet when a contact property of the thick sheet with respect to the toner removal roller is checked with eyes.

FIG. 7 is a diagram showing a state of a thick sheet P1 when a contact property of the thick sheet P1 with respect to the toner removal roller 70 is visually checked. As shown in FIG. 7, there is little change in behavior of the thick sheet P1 even when the vacuum airflow speed is changed. In addition, even when the vacuum airflow speed for stopping the air vacuum fan 73 is set to 0 m/s, both of a first surface and a second surface of the thick sheet P1 are reliably brought into contact with the roller main body 70*a* to raise no problem in the contact property thereof. On the rear surface of the thick sheet P1, the toner stain adhering thereto is removed, so there is no stain.

Figure 8:
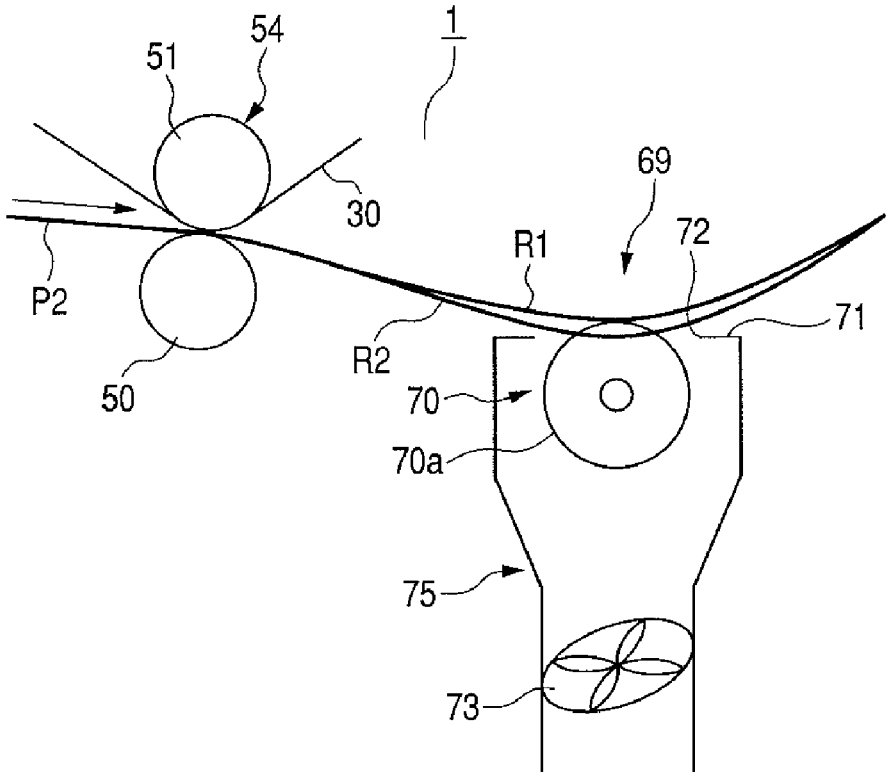
FIG. 8 is a diagram showing a state of a normal sheet when a contact property of a first surface of the normal sheet with respect to the toner removal roller is checked with eyes.

FIG. 8 is a diagram showing a state of a normal sheet P2 when a contact property of a first surface of the normal sheet P2 with respect to the toner removal roller 70 is visually checked. In a case where the vacuum airflow speed, for stopping the air vacuum fan 73 is set to 0 m/s when a toner image is transferred onto the first surface of the normal sheet P2, a contact amount of the normal sheet P2 with respect to the roller main body 70*a* is small as indicated by reference symbol R1. As a result, on the rear surface of the normal sheet P2, the toner stain is not completely removed and some of the toner stains are left, so the toner stain can be seen on the rear surface of the sheet in some degree. When the vacuum airflow speed is increased to 1.7 m/s, the contact amount of the normal sheet P2 with respect to the roller main body 70*a* becomes large as indicated by reference symbol R2, so the toner stain cannot be seen on the rear surface of the normal sheet P2. As shown in FIG. 8, the normal sheet P2 indicated by reference symbol R2 seems to dig into the toner removal roller 70. However, FIG. 8 shows that the normal sheet P2 is deformed to be yielded because the toner removal roller 70 is a rotary brush.

Figure 9:
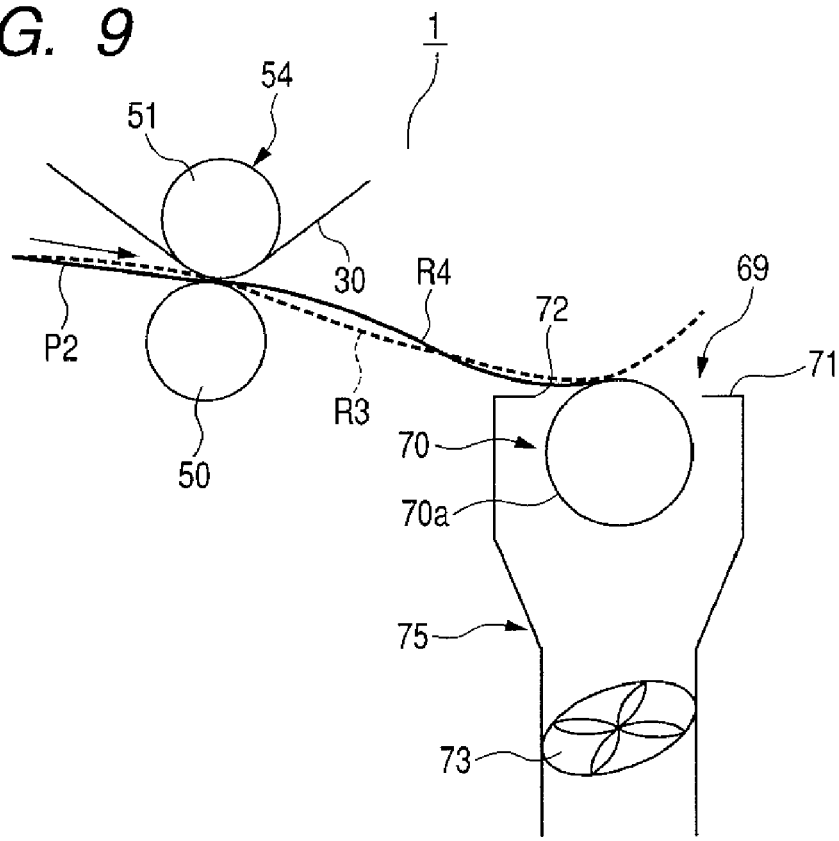
FIG. 9 is a diagram showing a state of a normal sheet when a contact property of a second surface of the normal sheet with respect to the toner removal roller is visually checked.

FIG. 9 is a diagram showing a state of the normal sheet P2 when a contact property of a second surface of the normal sheet P2 with respect to the toner removal roller 70 is checked with eyes. The toner image is transferred onto the first surface of the normal sheet P2, and is then heated and pressurized by the fixing device 26 to fix the toner image, so the normal sheet P2 curls in a direction apart from the toner removal roller 70. As a result, when the vacuum airflow speed is set to 0 m/s, the normal sheet P2 is transported while a leading edge of the normal sheet P2 is not brought into contact with the toner removal roller 70, but the normal sheet P2 is brought into contact therewith from the middle part of the normal sheet P2, as indicated by reference symbol R3. Therefore, the toner stain can be seen on the rear surface of the normal sheet P2. When the vacuum airflow speed is increased to 2.3 m/s; the normal sheet P2 is brought into contact with the roller main body 70*a* from the curled leading edge thereof as indicated by reference symbol R4, so the toner stain cannot seen on the rear surface of the normal sheet P2. Accordingly, it is apparent that, when the toner image is formed on the second surface of the normal sheer P2, it is necessary to set the vacuum airflow speed to 2.3 m/s or more.

Figure 10:
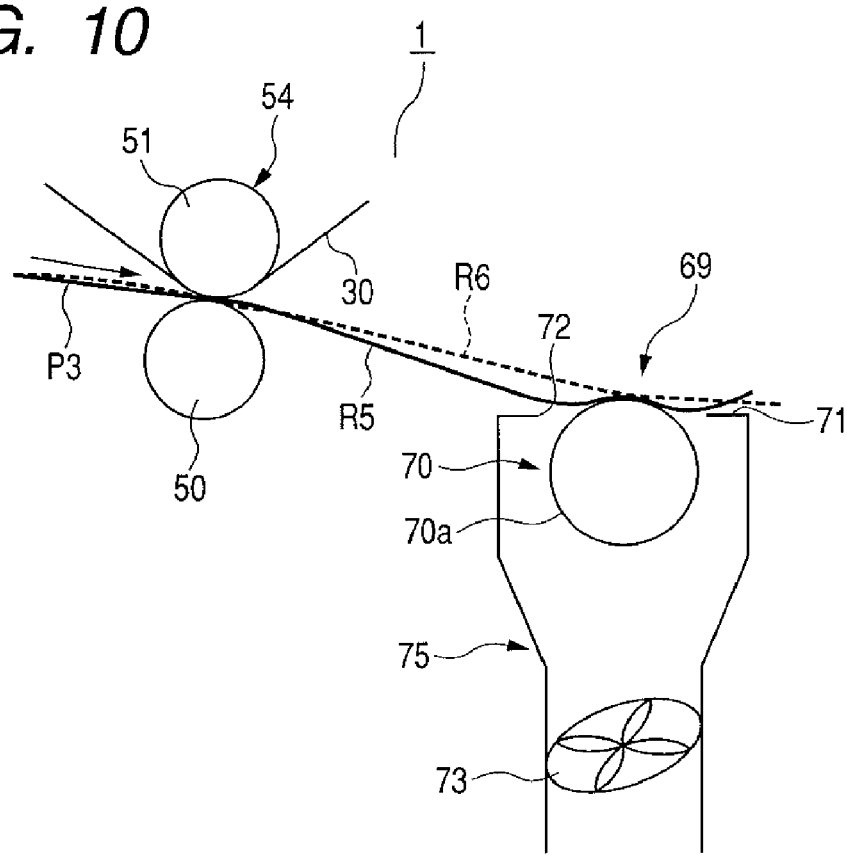
FIG. 10 is a diagram showing a state of a thin sheet when a contact property of the thin sheet with respect to the toner removal roller is visually checked.

FIG. 10 is a diagram showing a state of a thin sheet P3 when a contact property of the thin sheet P3 with respect to the toner removal roller 70 is checked with eyes. When the vacuum airflow speed is set to 0.9 m/s, the thin sheet P3 is brought into contact with the roller main body 70*a* as indicated by reference symbol R6. However, in order to eliminate the toner stain on the rear surface of the thin sheet P3, it is necessary to increase the vacuum airflow speed up to 1.9 m/s. In addition, when the vacuum airflow speed is set to 2.1 m/s or more, a suction force for sucking the thin sheet P3 becomes excessively large, so the thin sheet P3 stays on the toner removal roller 70 to cause jamming as indicated by reference character R5. Accordingly, when the vacuum airflow speed is set to 1.5 m/s, the thin sheet P3 is brought into contact with the toner removal roller 70 without staying on the toner removal roller 70 and without causing jamming, so there is no toner stain on the rear surface of the thin sheet P3. Therefore, it is preferable that, in the case of the thin sheet P3, the vacuum airflow speed be set to 1.5 m/s.

It should be noted that the thin sheet P3 has the same shape as indicated by reference symbol R5 in both of a case where the vacuum airflow speed is 2.1 m/s and in a case where the vacuum airflow speed is 1.5 m/s, but absorbed states of the thin sheet P3 with respect to the toner removal roller 70 in the both cases are different.

As described above, the toner removal device 69 according to this embodiment can regulate the suction force by changing the rotational speed of the air vacuum fan 73 according to the types of the sheets P and the image forming modes. As a result, the toner removal device 69 according to this embodiment can easily remove the toner stain adhering to the rear surface of the sheet P3 irrespective of the types of the sheets P and the image forming modes. In particular, when the toner image is formed on the sheet P without providing any margin on the periphery of the sheet, the amount of toner adhering to the rear surface of the sheet P is relatively large. However, in such the case, the toner stain which causes the stain on the rear surface of the sheet.

(Toner Stain Removal Device According to a Second Embodiment)

Figures 11, 12:
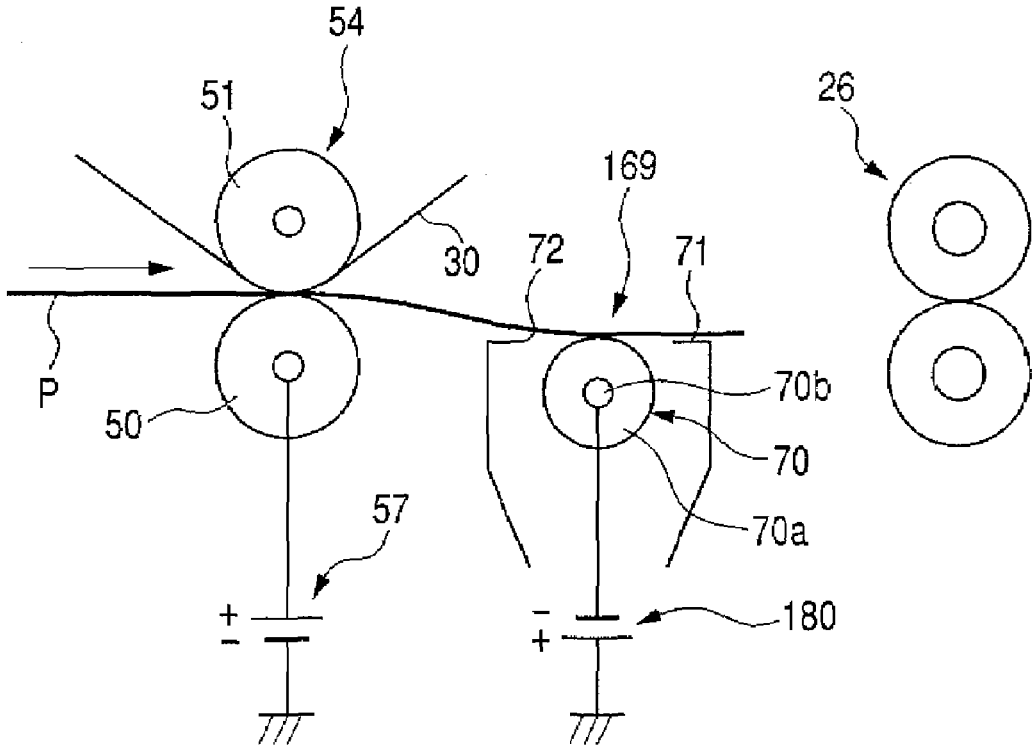
FIG. 11 is a schematic view showing a toner stain removal device according to a second embodiment of the present invention.
FIG. 12 is a table showing an experimental result of an optimum applied voltage for each sheet which is obtained by changing an applied voltage of a bias applying power and by visually checking to confirm a contact state between a sheet and a roller main body, and a removal state of toner stain.

FIG. 11 is a schematic view showing a toner stain removal device 169 according to a second embodiment of the present invention. The same reference numerals and characters are given to parts of the toner stain removal device 169 of the second embodiment which are identical with that of the first embodiment, and the description thereof will be omitted or will be schematically given.

While the toner stain removal device 69 according to the first embodiment brings a sheet into contact with the toner removal roller 70 by sucking air, a toner stain removal device 169 according to this embodiment brings a sheet into contact with the toner removal roller 70 by utilizing the suction force caused by static electricity.

The toner stain removal device 169 includes the toner removal roller 70 serving as a cleaning member, a bias applying power 180 serving as a biasing device, and the transport guide member 71. In this regard, rubber used herein is a conductive rubber formed of a conductive urethane obtained by dispersing conductive carbon, urethane foam, silicon, or the like. In addition, the toner removal roller 70, the rotary brush roller may be replaced with a fixed band-like brush which is arranged in a direction crossing the sheet transport direction.

The toner removal roller 70 is constituted of the roller main body 70*a* and the rotation axis 70*b*. A bias of the biasing applying power 180 is applied to the rotation axis 70*b*. A material and a width of the roller main body 70*a*, and a sheet transport speed, a rotational speed, and the like of the toner removal roller 70 are the same as those of the first embodiment, so the descriptions thereof will be omitted.

The bias applying power 180 applies to the rotation axis 70*b* of the toner removal roller 70 a bias having a polarity reverse to a charging polarity of the sheet P. For example, when the voltage supply part 57 applies a positive bias to the second transfer outer roller 50 to thereby charge the sheet P to positive, the bias applying power 180 applies a negative bias to the toner removal roller 70. Thus, when the toner removal roller 70 is charged to the polarity reverse to that of the sheet P, the sheet P is attracted to the toner removal roller 70, thereby removing the toner stain adhering to the rear surface of the sheet P by rotation thereof.

The suction force of the toner removal roller 70 for sucking the sheet P is regulated according to the applied voltage of the bias applying power 180.

FIG. 12 is a table showing an experimental result of an optimum applied voltage for each sheet which is obtained by changing an applied voltage of the bias applying power 180 and by visually checking to confirm a contact state between the sheet P and the roller main body 70*a*, and a removal state of toner stain.

Data shown in FIG. 12 is obtained under a circumstance in which a room temperature is 23° C., a humidity is 50%, and an amount of water contained in a sheet is 8.74 gr/kg. The sheets to be measured are a thick sheet (i.e., sheet having a large thickness) having a base weight of 160 g/m$^2$ a normal sheet (i.e., plain sheet) having a base weight of 80 g/m$^2$ or more and less than 160 g/m$^2$, and a thin sheet (i.e., sheet having a small thickness) having a basis weight of 52 g/m$^2$ or more and less than 80 g/m$^2$. Each size of the sheets is an A3-size. With regard to the normal sheet and the thick sheet, a confirmation as to a two-side mode of forming a toner image on both sides of a sheet is also made. With regard to the thin sheet, the confirmation as to the two-side mode is not made because show-through significantly occurs in the thin sheet (i.e., sheet can be seen through).

Both of the first surface and the second surface of the thick sheet are reliably brought into contact with the roller main body 70*a* without applying a voltage thereto (i.e., with an applied voltage of 0 V), so there is no problem in contact property. In addition, the toner stain adhering to the rear surface of the thick sheet is removed, so the toner stain cannot be seen.

The normal sheet is less likely to contact the roller main body 70*a* when a toner image is transferred onto the first surface thereof with the applied voltage of 0 V. As a result, the toner stain adhering to the rear surface of the normal sheet is not completely removed, so a small amount of stain can be seen on the rear surface thereof. When the applied voltage is increased to 500 V, the contact amount of the normal sheet with respect to the roller main body 70*a* is increased. Thus, there is no stain on the rear surface of the normal sheet.

The normal sheet is curled in a direction apart from the toner removal roller 70 because the toner image is transferred onto the first surface of the sheet before the toner image is heated and pressurized by the fixing device 26 to be fixed on the sheet. Thus, when the applied voltage is increased to 1200 V, the normal sheet is brought into contact with the roller main body 70*a* from the curled leading edge thereof, so no stain can be seen on the rear surface of the sheet. Therefore, it is apparent that, in a case where the toner image is formed on the second surface of the normal sheet, the applied voltage needs to be set to 1200 V or more.

The thin sheet is brought into contact with the roller main body 70*a* with the applied voltage of 500 V. However, it is necessary to increase the applied voltage to 800 V so as to prevent the toner stain from being seen on the rear surface of the sheet. Further, when the applied voltage is set to 1000 V or more, the suction force for sucking the thin sheet becomes so large that the thin sheet stays on the toner removal roller 70 to cause jamming. Meanwhile, when the applied, voltage is set to 800 V, the thin sheet is brought into contact with the toner removal roller 70 without staying on the toner removal roller 70 and without causing jamming, so there is no stain on the rear surface of the sheet. Accordingly, in the case of the thin sheet, it is preferable that the applied voltage be set to 800 V.

As described above, the toner stain removal device 169 according to this embodiment can regulate the applied voltage of the bias applying power 180 according to the types of the sheets P and the image forming modes. As a result, the toner stain removal device 169 according to this embodiment can remove the toner stain adhering to the rear surface of the sheet to clean the rear surface of the sheet irrespective of the types of the sheets and the image forming modes. In particular, when the toner image is formed on the sheet without providing any margin on the periphery of the sheet, the amount of the toner stain adhering to the rear surface of the sheet becomes relatively large. Even in such the case, it is possible to easily remove unnecessary toner which causes staining on the rear surface of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-248259, filed Aug. 29, 2005, which is hereby incorporated by reference herein in its entirety.

What is claimed is

1. An image forming apparatus, comprising:

an image bearing member which bears a toner image;

a transfer device which transfers the toner image onto a sheet from the image bearing member;

a fixing device which fixes on the sheet the toner image which has been transferred onto the sheet;

a cleaning member which is arranged on a side of the transfer device with respect to the sheet to be transported from the transfer device to the fixing device, and removes a toner stain adhering to the sheet;

a biasing device which biases the sheet against a side of the cleaning member; and a controller which regulates a biasing force of the biasing device according to a type of the sheet.

2. An image forming apparatus according to claim 1, wherein the controller controls the biasing device so that the biasing force of the biasing device does not act on a first sheet, but acts on a second sheet having a thickness smaller than that of the first sheet.

3. An image forming apparatus according to claim 1, wherein the biasing device comprises a vacuum fan which sucks air to suck and bring the sheet into contact with the cleaning member; and wherein the controller regulates a rotational speed of the vacuum fan.

4. An image forming apparatus according to claim 1, wherein the biasing device comprises a bias applying power supply which applies a bias having a polarity reverse to that of a transfer bias which is applied to the transfer device; and wherein the controller regulates a voltage of the bias applying power supply.

5. An image forming apparatus, comprising:

an image bearing member which bears a toner image;

a transfer device which transfers the toner image onto a sheet from the image bearing member;

a fixing device which fixes on the sheet the toner image which has been transferred onto the sheet;

a cleaning member which is arranged on a side of the transfer device with respect to the sheet to be transported from the transfer device to the fixing device, and removes a toner stain adhering to the sheet;

a biasing device which biases the sheet against a side of the cleaning member; and a controller which regulates a biasing force of the biasing device according to an image forming mode.

6. An image forming apparatus according to claim 5, wherein the controller changes the biasing force of the biasing device for a case of a first sheet and a case of a second sheet having a thickness smaller than a thickness of the first sheet.

7. An image forming apparatus according to claim 6, wherein the controller controls the biasing device so that the biasing force acting on the first sheet becomes larger than the biasing force acting on the second sheet in a one-side mode of forming an image on one surface of the sheet.

8. An image forming apparatus according to claim 6, wherein the controller controls the biasing device so that the biasing force acting on the second sheet, one surface of which is formed with the toner image in a one-side mode of forming an image on one surface of the sheet becomes smaller than the biasing force acting on the first sheet, both surfaces of which are formed with the toner images in a two-side mode of forming images on both sides of the sheet.

9. An image forming apparatus according to claim 6, wherein the controller controls the biasing device so that a biasing force acting on the first sheet, both surfaces of which are formed with toner images, in a two-side mode of forming images on both surfaces of the sheet becomes larger than that acting on the first sheet, one surface of which is formed with a toner image, in a one-side mode of forming an image on one surface of the sheet.

10. An image forming apparatus according to claim 5, wherein the biasing device comprises a vacuum fan which sucks air to suck and bring the sheet into contact with the cleaning member, and wherein the controller regulates a rotational speed of the vacuum fan.

11. An image forming apparatus according to claim 5, wherein the biasing device comprises a bias applying power supply which applies a bias having a polarity reverse to that of a transfer bias which is applied to the transfer device, to the cleaning member, and wherein the controller regulates a voltage of the bias applying power supply.

* * * * *